US012742310B2

(12) United States Patent
Williams et al.

(10) Patent No.: US 12,742,310 B2
(45) Date of Patent: Sep. 22, 2026

(54) IMPLEMENT METERING CONTROL

(71) Applicant: Caterpillar Inc., Peoria, IL (US)

(72) Inventors: James Joseph Williams, Clayton, NC (US); Jeffrey Michael Pillis, Apex, NC (US); Fuaad Ahmed Sayeed, Dunlap, IL (US); Gavin David Ripley, Garner, NC (US)

(73) Assignee: Caterpillar Inc., Peoria, IL (US)

( * ) Notice: Subject to any disclaimer, the term of this patent is extended or adjusted under 35 U.S.C. 154(b) by 381 days.

(21) Appl. No.: 18/540,235

(22) Filed: Dec. 14, 2023

(65) Prior Publication Data

US 2025/0198123 A1 Jun. 19, 2025

(51) Int. Cl.
*E02F 9/22* (2006.01)
*E02F 9/20* (2006.01)

(52) U.S. Cl.
CPC ..... *E02F 9/221* (2013.01); *E02F 9/2004* (2013.01); *E02F 9/2221* (2013.01)

(58) Field of Classification Search
None
See application file for complete search history.

(56) References Cited

U.S. PATENT DOCUMENTS 5,235,809 A * 8/1993 Farrell ..... E02F 9/221 60/494
5,287,699 A 2/1994 Takamura et al.
6,757,992 B1 * 7/2004 Berger ..... E02F 3/405 701/50
6,763,661 B2 7/2004 Tabor et al.
7,062,350 B2 6/2006 Peterson
7,117,952 B2 * 10/2006 Bares ..... E02F 3/405 37/238
7,467,514 B2 * 12/2008 Patel ..... E02F 9/2296 60/381
8,869,520 B2 * 10/2014 Vigholm ..... E02F 9/2235 60/459
9,556,589 B2 * 1/2017 Brooks ..... E02F 3/405
9,850,639 B2 * 12/2017 Fletcher ..... E02F 3/434
10,246,855 B2 4/2019 Greer
10,508,410 B2 * 12/2019 Hoshaku ..... E02F 3/437
10,597,845 B2 3/2020 Kenkel et al.
2003/0209134 A1 * 11/2003 Tabor ..... E02F 3/405 91/275
2003/0223816 A1 * 12/2003 Potts ..... E01C 19/288 404/117
2005/0203691 A1 * 9/2005 Kim ..... E02F 3/967 701/50

(Continued)

FOREIGN PATENT DOCUMENTS

EP 4008841 A1 6/2022

*Primary Examiner* — Jonathan M Dager

(57) ABSTRACT

A controller for a machine may receive an activation command to activate a metering operation that is to vibrate an implement of the machine by repetitive changing of at least one of an angle or a position of the implement. The controller may generate, while the metering operation is ongoing, a metering control signal for the metering operation by adjusting a baseline metering signal in accordance with sensor data relating to a characteristic of the implement. The controller may cause actuation of an implement actuator for the implement in accordance with the metering control signal.

21 Claims, 10 Drawing Sheets

(56) References Cited

U.S. PATENT DOCUMENTS

2005/0211449 A1* 9/2005 Bares ..... E02F 3/405
172/2
2006/0085096 A1* 4/2006 Peterson ..... E02F 9/221
701/50
2006/0248885 A1* 11/2006 Buckmier ..... E02F 9/221
60/484
2007/0039457 A1* 2/2007 Vigholm ..... E02F 9/221
91/459
2009/0056322 A1* 3/2009 Brinkman ..... E02F 9/221
60/325
2015/0134209 A1* 5/2015 Lee ..... E02F 9/221
701/50
2017/0002542 A1* 1/2017 Fletcher ..... E02F 3/434
2018/0100290 A1* 4/2018 Greer ..... F15B 11/16
2018/0180067 A1* 6/2018 Stavrou ..... F15B 15/2815
2019/0093310 A1* 3/2019 Kenkel ..... E02F 3/422
2020/0123738 A1* 4/2020 Espinosa ..... E02F 9/221
2020/0263384 A1* 8/2020 Currier ..... E02F 9/2025
2021/0156116 A1* 5/2021 Wu ..... E02F 9/2235
2021/0230838 A1* 7/2021 Wu ..... E02F 3/431
2022/0186471 A1* 6/2022 Cairns ..... E02F 9/2221
2022/0325497 A1* 10/2022 Currier ..... E02F 3/434
2023/0024622 A1* 1/2023 Hoaby ..... E02F 9/2203
2023/0104698 A1* 4/2023 Young ..... E02F 9/207
701/22
2023/0151582 A1* 5/2023 Busquets ..... E02F 3/431
74/471 R
2023/0193594 A1* 6/2023 Young ..... E02F 3/422
701/22
2023/0279641 A1* 9/2023 Young ..... E02F 9/207
701/50
2025/0237038 A1* 7/2025 Takenaka ..... E02F 9/2207
2025/0270784 A1* 8/2025 Sayeed ..... E02F 3/3677
2025/0333925 A1* 10/2025 Sulzer ..... E02F 3/405

* cited by examiner

800

850

IMPLEMENT METERING CONTROL

TECHNICAL FIELD

The present disclosure relates generally to work machines and, for example, to implement metering control.

BACKGROUND

A loader-type machine (e.g., a wheel loader) is equipped with a bucket that can be used to transport loose payload material, such as dirt, gravel, or the like, at a worksite. Using a joystick or another control device, an operator may rapidly oscillate the bucket along its tilt axis to cause a shaking, or a vibration, of the bucket that produces controlled material spillage, which can be referred to as "metering." During a metering operation, an operator may experience arm fatigue due to the constant rapid actuation of the joystick or other control device needed to produce the shaking. Moreover, a less-skilled operator may meter material imprecisely and inconsistently.

U.S. Pat. No. 10,597,845 (the '845 patent) discloses an implement vibration system. The implement vibration system includes a controller that monitors a vibration activation device and sends movement signals to an electrohydraulic mechanism to control implement movement. When the vibration activation device is activated, the controller sends vibration signals to the electrohydraulic mechanism to cause the implement to vibrate. The '845 patent also discloses monitoring a vibration signal adjustment control that enables an operator to select parameters of the vibration signals, and when the vibration activation device is activated, generating the vibration signals based on the selected parameters.

The implement vibration system of the '845 patent produces vibration signals that do not adapt over time in response to changing conditions. Repeatable automated metering is complex, and should account for variables including linkage kinematics, implement position, implement size, implement weight, implement center of gravity, a payload material type, and/or a payload material mass. For example, throughout a metering cycle, a weight and/or a center of gravity of a payload may change, which can affect a consistency of automated metering. In particular, a tilt angle and/or an angular velocity of the implement may drift away from expected values and/or ranges. As an example, when the implement is heavily loaded, the implement may tend to drift toward a dump position (referred to as "dump indexing"), and when the implement is lightly loaded, the implement may tend to drift toward a rack position (referred to as "rack indexing"). Accordingly, in the implement vibration system of the '845 patent, the implement may deviate from a desired tilt angle and/or vibration frequency as a weight and/or a center of gravity of the implement's payload changes. This can lead to dump indexing, rack indexing, insufficient vibratory action, and/or undesirable resonance of the implement that can degrade metering precision and/or damage the machine.

The control system of the present disclosure solves one or more of the problems set forth above and/or other problems in the art.

SUMMARY

A control system for an implement of a machine may include one or more sensors configured to detect a characteristic of the implement. The control system may include an implement actuator configured to actuate the implement.

The control system may include a controller electrically connected with the one or more sensors and the implement actuator. The controller may be configured to receive an activation command to activate a metering operation that is to vibrate the implement by repetitive changing of at least one of an angle or a position of the implement. The controller may be configured to obtain, from the one or more sensors, sensor data relating to the characteristic of the implement. The controller may be configured to generate, while the metering operation is ongoing, a metering control signal for the metering operation by adjusting a baseline metering signal in accordance with the sensor data. The controller may be configured to output the metering control signal, to the implement actuator, to cause actuation of the implement actuator in accordance with the metering control signal.

A method may include receiving, by a controller of a machine, an activation command to activate a metering operation that is to vibrate an implement of the machine by repetitive changing of at least one of an angle or a position of the implement. The method may include generating, by the controller and while the metering operation is ongoing, a metering control signal for the metering operation by adjusting a baseline metering signal in accordance with sensor data relating to a characteristic of the implement. The method may include causing actuation of an implement actuator for the implement in accordance with the metering control signal.

A controller may include one or more memories and one or more processors communicatively coupled to the one or more memories. The controller may be configured to obtain, from one or more sensors, sensor data relating to a characteristic of an implement of a machine during a metering operation for the implement. The controller may be configured to generate, while the metering operation for the implement is ongoing, a metering control signal for the metering operation by adjusting a baseline metering signal in accordance with the sensor data. The controller may be configured to cause actuation of an implement actuator for the implement in accordance with the metering control signal.

DETAILED DESCRIPTION

This disclosure relates to a control system for automated metering of an implement.

Figure 1:
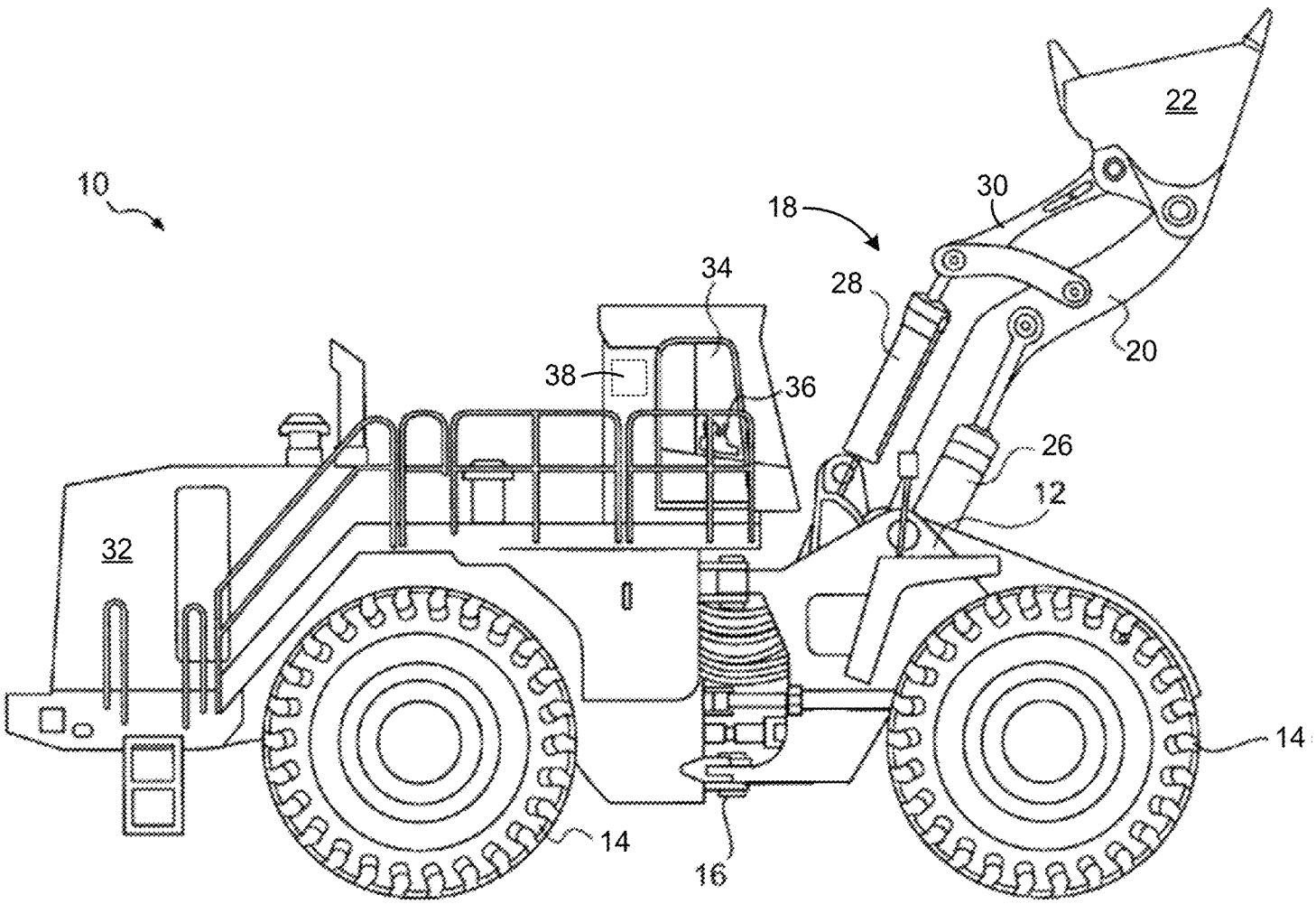
FIG. 1 is a side view of an example machine.

FIG. 1 is a side view of an example machine 10. The machine 10 may perform earth moving, excavation, or another operation associated with an industry such as construction or mining, among other examples. That is, the machine 10 is a work machine. For example, as illustrated in FIG. 1, the machine 10 is a wheel loader. However, the machine 10 may be another type of machine, such as an excavator, a dozer, a backhoe loader, a skid steer loader, a dump truck, or the like.

The machine 10 includes a frame 12 that is supported by one or more traction devices 14 used to propel the machine 10 in a forward direction and/or a rearward direction. The traction devices 14 are configured to engage a ground surface, such as a road or another type of terrain. The traction devices 14 may include wheels, as shown, and/or tracks, among other examples. The frame 12 may include a front section and a rear section connected by an articulation joint 16 that allows the front section of the frame 12 to pivot about the articulation joint 16 relative to the rear section of the frame 12, thereby steering the machine 10. Additionally, or alternatively, the machine 10 may include another type of steering system, such as a rack and pinion mechanism or independent gear drives or motors associated with individual traction devices 14, among other examples.

The machine 10 includes a linkage assembly 18 movably coupled to the frame 12. The linkage assembly 18 includes a lift arm 20 movably coupled to the frame 12, and an implement 22 movably coupled to the lift arm 20. The implement 22 may be a bucket, as shown, or another type of implement capable of performing work operations such as loading, stock piling, dumping, or the like. For example, the implement 22 may be a multi-purpose bucket of a loader, an implement with an ejector cylinder, a side-dump bucket, and/or a hoistable bed of a truck, among other examples. The linkage assembly 18 also includes one or more actuators (e.g., hydraulic actuators) configured to provide movement of the linkage assembly 18. As shown, the linkage assembly 18 may include one or more lift actuators 26, connected to the frame 12 and the lift arm 20, that are configured to raise and lower the lift arm 20 relative to the frame 12. Furthermore, the linkage assembly 18 may include one or more tilt actuators 28 configured to tilt the implement 22. For example, the linkage assembly 18 may include a tilt linkage 30 that is pivotably connected to the tilt actuator(s) 28, the lift arm 20, and the implement 22 to enable tilting of the implement 22. The implement 22 may be tilted (e.g., via the tilt actuator(s) 28 and the tilt linkage 30) between a dump position (e.g., where a leading edge of the implement 22 is rotated toward a ground surface) and a rack position (e.g., where a leading edge of the implement 22 is rotated away from a ground surface).

The frame 12 supports a power source 32. The power source 32 may be an engine, such as a diesel engine, a gasoline engine, or a gaseous fuel engine (e.g., a natural gas engine), among other examples. Additionally, or alternatively, the power source 32 may be a fuel cell or an energy storage device (e.g., a battery), among other examples. Here, the power source 32 may be coupled to one or more electric motors (not shown) of the machine 10. The power source 32 is configured to produce a mechanical and/or an electrical power output used to drive the traction devices 14, a steering system of the machine 10, and/or the linkage assembly 18.

The frame 12 may support an operator station 34. The operator station 34 includes one or more controls 36, such as joysticks, pedals, levers, buttons, switches, knobs, touch screen controls, operator consoles, and/or a steering wheel, among other examples. The controls 36 enable an operator to control the machine 10 during operation. One or more controls 36 may be proportional-type controllers configured to generate control signals indicative of a desired position, force, velocity, and/or acceleration of the actuators of the linkage assembly 18. As an example, the controls 36 may include a joystick configured to control a tilt angle of the implement 22. As another example, the controls 36 may include a button configured to activate a metering operation for the implement 22. In some implementations, the machine 10 may be configured for remote controlled operation (e.g., a remote control for the machine 10 may include the joystick and/or the button) or autonomous operation.

The machine 10 includes a controller 38 (e.g., an electronic control module (ECM)) configured to electrically control various aspects of the machine 10. For example, the controller 38 may send and/or receive signals from various components of the machine 10 during operation of the machine 10. As an example, the controller 38 may be configured (e.g., with software) to control a metering operation for the implement 22, as described herein.

As indicated above, FIG. 1 is provided as an example. Other examples may differ from what is described with regard to FIG. 1.

Figure 2:
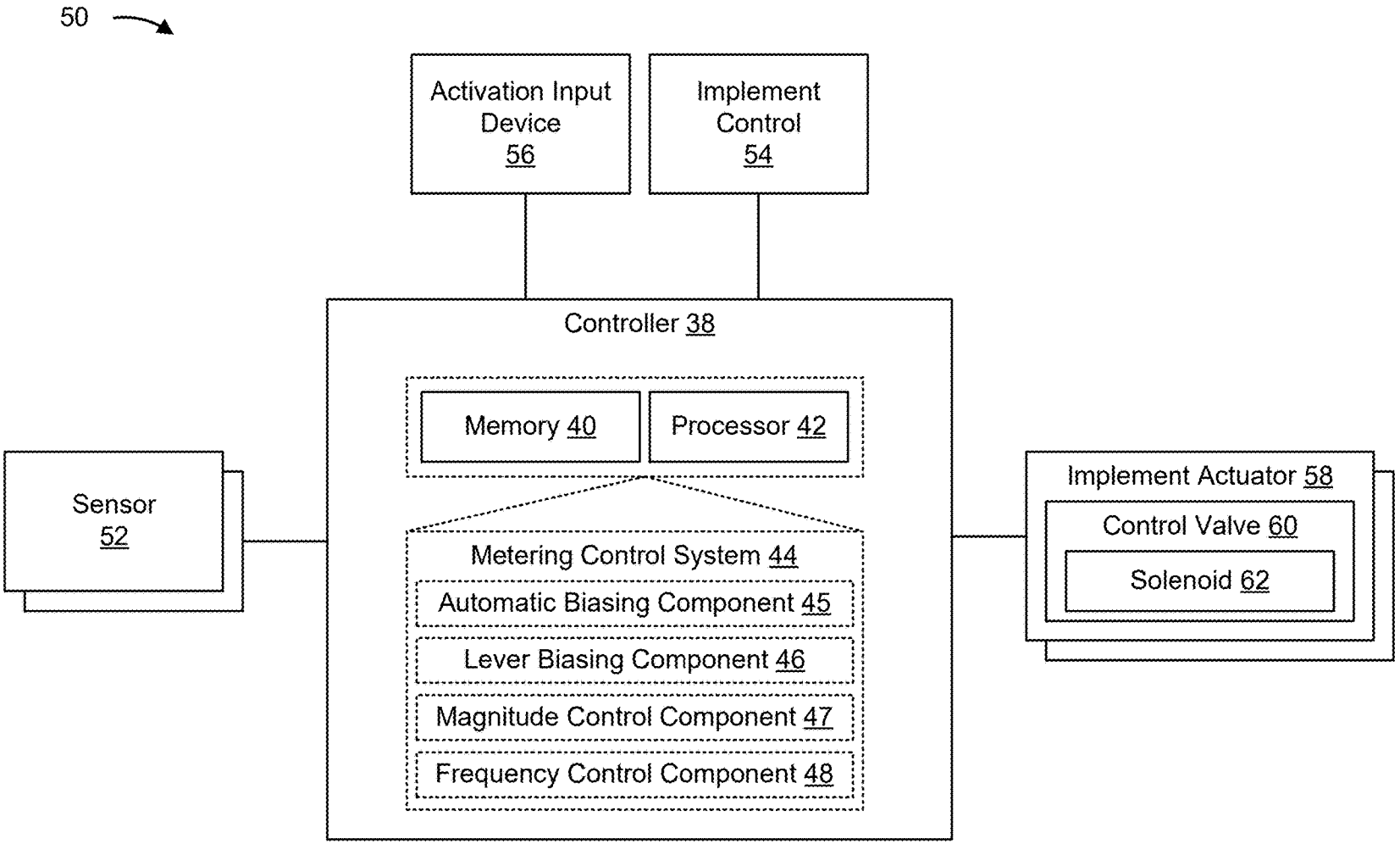
FIG. 2 is a diagram of an example control system.

FIG. 2 is a diagram of an example control system 50. The control system 50 may be configured for controlling a metering operation (e.g., an automatic metering operation) for the implement 22, as described herein. Besides metering, the control system 50 may also be configured and useful for a digging operation in which vibration of the implement 22 loosens ground material to facilitate digging, a leveling operation in which vibration of the implement 22 settles and levels material loaded in the implement 22 (e.g., which can be activated automatically based on implement position, for example, in a rack operation after a dig cycle, the leveling operation can be automatically activated for the last few degrees of travel of the implement 22), a breakout operation in which vibration of the implement 22 facilitates freeing a stuck implement 22 from a ground surface, and/or a sorting operation in which vibration of the implement 22 facilitates sorting or sifting of material in the implement 22.

As shown, the control system 50 may include the controller 38, one or more sensors 52, an implement control 54, an activation input device 56, and one or more implement actuators 58. The controller 38 may be electrically connected with (e.g., to enable the transmission and reception of signals) the sensor(s) 52, the implement control 54, the activation input device 56, and/or the implement actuator(s) 58.

The controller 38 may include one or more memories 40 and one or more processors 42 communicatively coupled to the one or more memories 40. A processor 42 may include a central processing unit, a graphics processing unit, a microprocessor, a controller, a microcontroller, a digital signal processor, a field-programmable gate array, an application-specific integrated circuit, and/or another type of processing component. The processor 42 may be implemented in hardware, software, or a combination of hardware and software. The processor 42 may be capable of being programmed to perform one or more operations or processes described elsewhere herein. A memory 40 may include volatile and/or nonvolatile memory. For example, the memory 40 may include random access memory (RAM), read only memory (ROM), a hard disk drive, and/or another type of memory (e.g., a flash memory, a magnetic memory, and/or an optical memory). The memory 40 may be a non-transitory computer-readable medium. The memory 40 may store information, one or more instructions, and/or software (e.g., one or more software applications) related to the operation of the controller 38.

The controller 38 may implement a metering control system 44. The metering control system 44 may include an automatic biasing component 45, a lever biasing component 46, a magnitude control component 47, and/or a frequency control component 48. The components of the metering control system 44 may be implemented in hardware and/or software of the controller 38. The metering control system 44 may be configured to monitor and control a metering operation for the implement 22.

A sensor 52 may include one or more devices configured to detect a condition or characteristic relating to the machine 10. For example, the sensor 52 may include a position sensor, such as a rotary sensor (e.g., that measures angular rotation relative to two planes), configured to detect a position of the implement 22. The control system 50 may include a lift position sensor 52 configured to measure an angle between the frame 12 and the lift arm 20. The control system 50 may include a tilt position sensor 52 configured to measure an angle between the lift arm 20 and the tilt linkage 30. Measurements taken by the lift position sensor 52 and/or the tilt position sensor 52 can be used to derive a lift height, a lift velocity, a lift acceleration, a lift angle, a linkage assembly angle, a linkage assembly velocity, a linkage assembly acceleration, an actuator extension, an implement angle (e.g., a bucket angle), an implement acceleration (e.g., a bucket acceleration), and/or an implement angular velocity (e.g., a bucket angular velocity), among other examples. Additionally, or alternatively, the sensor 52 may include an accelerometer, an inertial measurement unit (IMU), a gyroscope, or the like. The controller 38 may obtain, from a sensor 52, a sensor signal indicating sensor data (e.g., measurements taken by the sensor 52). "Sensor" is used herein in its broadest sense and, unless stated otherwise, encompasses any device for outputting signals representative of a property of a machine component.

An implement actuator 58 (e.g., an electrohydraulic actuator) is configured to actuate (e.g., control a movement of) the implement 22. For example, the implement actuator 58 may include a lift actuator 26, as described herein. As another example, the implement actuator 58 may include a tilt actuator 28, as described herein. While the following description is in terms of the implement actuator 58 being the tilt actuator 28, the description is also applicable to the implement actuator 58 being the lift actuator 26 or a combination of the lift actuator 26 and the tilt actuator 28. The implement actuator 58 may be a hydraulic actuator, such as a hydraulic cylinder (e.g., having a cylinder tube and a piston rod movable in the cylinder tube). The implement actuator 58 may include a control valve 60 (e.g., an electrohydraulic valve) configured to control fluid flow for the implement actuator 58. The control valve 60 may include one or more solenoids 62 configured to control opening and closing of the control valve 60. For example, in response to an electrical output from the controller 38, the solenoid(s) 62 may proportionately open and/or close one or more valve sections to cause actuation of the implement actuator 58. In some implementations, the implement actuator 58 may be a non-electrohydraulic actuator. For example, the implement actuator 58 may be an electric actuator.

The implement control 54 is configured to generate commands for a movement of the implement 22 based on an input provided by an operator to the implement control 54. The implement control 54 may include a control 36, as described herein. For example, the implement control 54 may include a joystick (e.g., configured to generate a voltage signal). The implement control 54 may have a neutral position, which is associated with an absence of operator-commanded movement of the implement 22. An operator may move the implement control 54 out from the neutral position to command movement of the implement 22. The controller 38 may receive, from the implement control 54, an implement movement command (e.g., as an implement movement command signal) indicating an operator-commanded movement of the implement 22. For example, an implement movement command may have a positive magnitude to indicate a rack movement of the implement 22 or a negative magnitude to indicate a dump movement of the implement 22. In some implementations, the positive and negative magnitudes may have an opposite relationship to dump and rack movements from that described above.

The controller 38 may be configured to generate an implement movement signal (e.g., an electrical signal) according to an implement movement command. For example, the controller 38 may translate the implement movement command into the implement movement signal (e.g., an electrical signal to power the solenoid(s) 62). For example, the implement movement signal may include a pulse-width-modulated (PWM) signal. The controller 38 may output the implement movement signal to the implement actuator 58 (e.g., to the solenoid(s) 62) to cause actuation of the implement actuator 58 and movement of the implement 22.

The activation input device 56 is configured to cause activation and/or deactivation of the metering operation for the implement 22. The activation input device 56 may include a control 36, as described herein. For example, the activation input device 56 may be a button (e.g., on an implement controller such as a joystick, on an operator console, or the like). As an example, the metering operation may be performed while the button is depressed, and the button being released may terminate the metering operation. For example, the controller 38 may receive an activation command (e.g., as an activation signal) from the activation input device 56 indicating that the metering operation is to be activated.

In some examples, the activation input device 56 may be the implement control 54 or a different operator control (e.g., an additional joystick). For example, the controller 38 may receive implement movement commands from the implement control 54 or the different operator control that are indicative of a metering-type movement of the implement 22 (e.g., back-and-forth movement of the implement 22). Continuing with the example, the controller 38 may detect that the implement movement commands are indicative of the metering-type movement (e.g., based on the implement movement commands oscillating between a positive magnitude and a negative magnitude), and the controller 38 may automatically activate the metering operation responsive to detecting that the implement movement commands are indicative of the metering-type movement. In this example, the activation command may be the implement movement commands from the implement control 54 or the different operator control that are indicative of a metering-type movement. In some implementations, the controller 38 may automatically activate the metering operation (e.g., in the absence of an activation command) based on detecting a particular movement pattern of the implement 22 and/or based on detecting that the implement 22 is in a particular position (e.g., that are usually associated with a metering operation being performed). In some implementations, the controller 38 or a different controller may be configured to monitor the machine 10 (e.g., monitor the linkage assembly 18, the tilt linkage 30, and/or the implement 22), and to autonomously issue a metering command based on monitoring the machine 10 (e.g., the different controller may issue the metering command to the controller 38).

The metering operation may include vibrating the implement 22 by repetitive changing of an angle (e.g., a tilt angle) of the implement 22 and/or a position of the implement 22. For example, the metering operation may include oscillation between a dump movement and a rack movement of the implement 22. The metering operation may be performed by a patterned actuation of the implement actuator 58 (e.g., by sequential extension and retraction of the implement actuator 58). The controller 38 may cause the patterned actuation of the implement actuator 58 using a metering control signal that is output to the implement actuator 58 (e.g., to the solenoid(s) 62).

The controller 38 may store information indicating a baseline metering signal (e.g., the information may indicate a waveform or an algorithm indicating one or more implement angle thresholds and/or one or more actuator extension thresholds used to trigger a directional change for the implement 22). For example, the controller 38 may generate the baseline metering signal using the stored information. The baseline metering signal may indicate a sequence of implement movement commands (e.g., for the solenoid(s) 62). For example, for each implement movement command, the baseline metering signal may indicate a magnitude for the command (e.g., a positive magnitude or a negative magnitude) and a time duration for the command. The sequence of implement movement commands of the baseline metering signal may alternate between rack commands and dump commands, to thereby cause a vibration of the implement 22 for the metering operation. While the metering operation is ongoing (e.g., while the activation input device 56 is being depressed), the controller 38 may apply the implement movement commands of the baseline metering signal in series and repetitively (e.g., the sequence of implement movement commands may be restarted from its beginning each time the sequence is completed, for as long as the metering operation is ongoing). In some implementations, the baseline metering signal may be particular to a configuration of the linkage assembly 18 and/or a configuration of the implement 22 (e.g., a weight of the implement 22 and/or a center of gravity of the implement 22, among other examples).

At a steady state, the baseline metering signal can provide acceptable vibration of the implement 22 for the metering operation. However, different loading operations performed by the machine 10 may involve different types or amounts of material payloads in the implement 22 (e.g., having different weights, densities, distributions, or the like), which can affect a vibratory action of the implement 22. As an example, over time, the metering operation may drift from target vibration characteristics (e.g., in connection with dump indexing and/or rack indexing) due to changes in a weight and/or a center of gravity of a payload material (e.g., dirt, gravel, or the like) in the implement 22. For example, a tilt angle and/or an angular velocity of the implement 22 may drift away from expected values and/or ranges. Moreover, operator-commanded movements of the implement 22 may also be provided during the metering operation.

To account for these dynamic conditions, the controller 38 (e.g., the metering control system 44) may be configured to generate a metering control signal for the metering operation by adjusting (e.g., scaling) the baseline metering signal. For example, the controller 38 may generate the metering control signal by adjusting the baseline metering signal while the metering operation is ongoing. The controller 38 may implement one or more closed-loop systems to continually and automatically adjust the baseline metering signal in response to operator input and/or sensor feedback. Adjusting the baseline metering signal may include increasing and/or decreasing a magnitude of the positive magnitude component of the baseline metering signal and/or increasing and/or decreasing a magnitude of the negative magnitude component of the baseline metering signal.

In some implementations, the controller 38 may generate the metering control signal by adjusting the baseline metering signal in accordance with sensor data. The sensor data may be generated by one or more of the sensors 52 (e.g., the lift position sensor 52 and/or the tilt position sensor 52), and the controller 38 may obtain the sensor data from the sensor(s) 52. The sensor data may relate to a characteristic of the implement 22, such as an angle of the implement 22 and/or a height of the implement 22 in space (e.g., a height of the implement 22 relative to a ground surface and/or relative to the frame 12), a velocity of the implement 22, and/or an acceleration of the implement 22, among other examples. For example, the sensor data may indicate characteristics of the implement 22 during the metering operation, such as an angle (e.g., a tilt angle) of the implement 22, an angular acceleration of the implement 22, and/or an angular velocity of the implement 22. For example, the controller 38 may use the sensor data (e.g., relating to the implement position) to derive the angle, the angular acceleration, and/or the angular velocity. In some implementations, the sensor data may indicate an angular velocity and/or an angular acceleration of the implement 22.

When there is operator-commanded movement of the implement 22 (e.g., when the implement control 54 is moved out of the neutral position) while the metering operation is ongoing, the controller 38 (e.g., using the lever biasing component 46) may generate the metering control signal by adjusting the baseline metering signal in accordance with the operator-commanded movement. For example, the controller 38 may receive, from the implement control 54, an implement movement command (e.g., as an implement movement command signal) for the implement 22. Continuing with the example, the controller 38 may generate an implement movement signal (e.g., for powering the solenoid(s) 62) according to the implement movement command. The operator-commanded movement of the implement 22 may be ongoing when the metering operation is first activated, or the operator-commanded movement of the implement 22 may be provided after activation of the metering operation while the metering operation is ongoing.

To generate the metering control signal, the controller 38 may employ the implement movement signal to modify the baseline metering signal, to thereby balance the metering operation with the operator-commanded movement. Employing the implement movement signal to modify the baseline metering signal may include scaling (e.g., shaping) the baseline metering signal in accordance with the implement movement signal, as described further in connection with FIG. 8. For example, the controller 38 may scale the positive magnitude component of the baseline metering signal and/or the negative magnitude component of the baseline metering signal (e.g., individually from each other). Accordingly, the metering control signal is not merely an aggregate signal that includes the baseline metering signal as a component and the implement movement signal as a component, but rather a new signal that blends characteristics of the baseline metering signal and the implement movement signal (e.g., while continually adapting based on sensor data).

When there is no operator-commanded movement of the implement 22 (e.g., when the implement control 54 is in the neutral position) while the metering operation is ongoing, the controller 38 (e.g., using the automatic biasing component 45) may generate the metering control signal by adjusting the baseline metering signal to achieve a target angle (e.g., a target tilt angle) for the implement 22. For example, the controller 38 may generate the metering control signal by adjusting the baseline metering signal in accordance with a difference between an angle (e.g., a tilt angle) of the implement 22, indicated by the sensor data, and the target angle for the implement 22. The target angle for the implement 22 may be the angle of the implement 22 at a time when the metering operation is initiated or a last operator-commanded angle of the implement 22 (e.g., that is commanded during the metering operation). In some implementations, when the metering operation is first initiated (e.g., when the activation input device 56 is first depressed), and if there is no operator-commanded movement of the implement 22, the metering control signal may correspond to the baseline metering signal without adjustment (or only having linkage kinematic control map adjustment, as described below).

The controller 38 may generate the metering control signal by employing an implement movement signal to modify the baseline metering signal, in a similar manner as described above (e.g., by scaling the positive magnitude component of the baseline metering signal and/or the negative magnitude component of the baseline metering signal). For example, in accordance with the difference between the angle of the implement 22 and the target angle, the controller 38 may determine an implement movement that is to be performed to return the implement 22 to the target angle, may generate an implement movement signal for achieving the implement movement, and may use the implement movement signal to modify the baseline metering signal.

The automatic biasing component 45 may include a closed-loop control system configured to acquire a target angle, and to maintain the implement 22 at the target angle (e.g., if the implement 22 has deviated from the target angle due to dump indexing or rack indexing). As an example, the automatic biasing component 45 may use a control loop mechanism to adjust the baseline metering signal, such as a proportional-integral-derivative (PID) controller, a proportional-integral (PI) controller, or a proportional controller, among other examples. The automatic biasing component 45 alleviates the need for constant operator input to maintain the position of the implement 22 (e.g., due to dump indexing or rack indexing) while metering, thereby reducing operator fatigue and enabling less-skilled operators to perform delicate metering operations. The automatic biasing component 45 may acquire the target angle by dynamically calculating and storing an intended angle or location for the implement 22 upon initiation of the metering operation. The automatic biasing component 45 may re-calculate the target angle during the metering operation (e.g., in response to an operator-commanded movement of the implement 22).

In some examples, while the metering operation is ongoing, the controller 38 (e.g., using the magnitude control component 47 and/or the frequency control component 48) may generate the metering control signal by adjusting the baseline metering signal to achieve a target angular movement (e.g., angular velocity and/or angular acceleration) for the implement 22. The target angular movement for the implement 22 may be a static value provisioned for the controller 38. In some implementations, the controller 38 may dynamically determine a value for the target angular movement based on a current machine pose, a machine cycle, a type and/or characteristics of the machine 10, and/or a type and/or characteristics of the linkage assembly 18. The controller 38 may adjust the baseline metering signal to achieve the target angular movement for the implement 22 regardless of whether there is operator-commanded movement of the implement 22 (e.g., both a lever biasing mode and an automatic biasing mode may be monitored and controlled by angular movement control).

In one example, the magnitude control component 47 may include a feed-forward control system that uses one or more linkage kinematic control maps for adjusting the baseline metering signal to control an angular movement (e.g., a tilt angular velocity and/or a tilt angular acceleration) for the implement 22. A linkage kinematic control map may indicate an adjustment to the baseline metering signal based on a position (in space) of the implement 22 (e.g., thereby accounting for positional kinematic gains). For example, the linkage kinematic control map may adjust for kinematic differences (e.g., which otherwise can lead to unacceptable resonance or insufficient vibratory action during the metering operation) due to the position of the implement 22. The linkage kinematic control map may include a matrix (e.g., a 16×16 matrix) of scalar outputs across a range of positions for the implement 22 (e.g., a range of heights of the lift arm 20 and a range of tilt angles of the implement 22). Moreover, the linkage kinematic control map may be particular to the machine 10 (e.g., each machine model and/or configuration may have its own linkage kinematic control map).

The controller 38 (e.g., using the magnitude control component 47) may generate the metering control signal by adjusting the baseline metering signal using the linkage kinematic control map. For example, the controller 38 may identify a height of the implement 22 (in space), an angle (e.g., a tilt angle) of the implement 22, a velocity of the implement 22, and/or an acceleration of the implement 22 in accordance with the sensor data, and the linkage kinematic control map may indicate a scalar value associated with the height and the angle. Accordingly, the controller 38 may adjust (e.g., scale) the baseline metering signal using the scalar value (e.g., which may suppress an amount of vibration used in the metering operation if the height and angle are associated with high resonance or may increase the amount of vibration used in the metering operation if the height and angle are associated with insufficient vibratory action). In this way, the linkage kinematic control map enables the target angular movement (e.g., angular velocity and/or angular acceleration) for the implement 22 to be achieved quickly and with minimal undesirable resonance.

In some examples, the controller 38 may generate the metering control signal by adjusting the baseline metering signal in accordance with a difference between an angular movement of the implement 22 (e.g., an angular velocity and/or an angular acceleration), indicated by the sensor data, and the target angular movement (e.g., target angular velocity and/or target angular acceleration) for the implement 22. The controller 38 may determine the angular movement (e.g., an instantaneous angular velocity and/or angular acceleration) of the implement 22 according to an angle of the implement 22 (e.g., changes to the angle over a time period) indicated by the sensor data. Additionally, or alternatively, the sensor data may indicate the angular movement of the implement 22.

The adjustment to the baseline metering signal, to achieve the target angular movement, may adjust an amplitude (e.g., magnitude) of the baseline metering signal. For example, the controller 38 (e.g., using the magnitude control component 47) may adjust the baseline metering signal by scaling the positive magnitude component and/or the negative magnitude component of the baseline metering signal to add or remove shake action of the implement 22, to thereby minimize an error between the actual angular movement and the target angular movement. The magnitude control component 47 may include a closed-loop control system configured to maintain the implement 22 at the target angular movement (e.g., if the implement 22 has deviated from the target angular movement due to a weight and/or a center of gravity of a payload of the implement 22 changing during the metering operation). As an example, the magnitude control component 47 may use a control loop mechanism to adjust the baseline metering signal, such as a PID controller, a PI controller, or a proportional controller, among other examples.

Additionally, or alternatively, the adjustment to the baseline metering signal, to achieve the target angular movement, may adjust a frequency of the baseline metering signal. For example, the controller 38 (e.g., using the frequency control component 48) may adjust the baseline metering signal by modifying a frequency of the baseline metering signal. As an example, as described herein, the baseline metering signal may have a sequence of implement movement commands that are characterized by pulses of the baseline metering signal, and the controller 38 may adjust a frequency of the pulses. The frequency control component 48 may include a closed-loop control system configured to maintain the implement 22 at the target angular movement. As an example, the frequency control component 48 may use a control loop mechanism to adjust the baseline metering signal, such as a PID controller, a PI controller, or a proportional controller, among other examples.

In some examples, the machine 10 may include an operator control (e.g., a knob, a slider, or the like) configured to cause adjustment (e.g., increase or decrease) of a shake action of the implement 22. For example, the controller 38 may receive an operator-input adjustment command indicating an adjustment to the target angular movement (e.g., target angular velocity and/or angular acceleration), and the controller 38 may generate the metering control signal by adjusting the baseline metering signal in accordance with the adjustment to the target angular movement.

The adjustments to the baseline metering signal described herein may be made individually or in combination (e.g., concurrently or sequentially). For example, the controller 38 may generate the metering control signal by adjusting the baseline metering signal using one or more of the automatic biasing component 45, the lever biasing component 46, the magnitude control component 47 (e.g., the feed-forward control system and/or the closed-loop control system), and/or the frequency control component 48. Thus, an adjustment to the "baseline metering signal" described herein may refer to an adjustment to the original (un-adjusted) baseline metering signal or an adjustment to the baseline metering signal as already adjusted by one or more other adjustments. In some examples, the automatic biasing component 45 may be inactive when the lever biasing component 46 is active (e.g., the controller 38 may not adjust the baseline metering signal using the automatic biasing component 45 and the lever biasing component 46 at the same time). For example, the controller 38 may interpret a non-neutral position of the implement control 54 as an indication that the operator is to manually control an angle of the implement 22 while metering.

The controller 38 may cause actuation of the implement actuator 58 in accordance with the metering control signal generated by the controller 38. For example, the controller 38 may output the metering control signal, as an electrical signal (e.g., a PWM electrical output), to the solenoid(s) 62 of the control valve 60 for the implement actuator 58. As an example, a current of the electrical signal may be in accordance with the metering control signal. The actuation of the implement actuator 58 in accordance with the metering control signal achieves a vibration of the implement 22 for the metering operation.

The controller 38 may continuously generate the metering control signal using the baseline metering signal, as described herein, for a duration of the metering operation. For example, the controller 38 may make various needed adjustments to the baseline metering signal (e.g., in real time or near-real time), as described herein, for a duration of the metering operation. The duration of the metering operation may be dictated by the activation command provided by the activation input device 56, as described herein. For example, while the controller 38 is receiving the activation command from the activation input device 56 (e.g., while the activation input device 56 is depressed), the controller 38 may continue the metering operation, and the controller 38 may terminate the metering operation when the activation command is no longer received from the activation input device 56 (e.g., the activation input device 56 is released).

In some implementations, the controller 38 may initiate a metering timer at a start of the metering operation. Accordingly, the controller 38 may terminate the metering operation at an expiration of the metering timer (e.g., regardless of whether the activation input device 56 is providing the activation command). The metering timer provides a safeguard in the event that the metering operation is ongoing for an excessive duration. In some implementations, the controller 38 may monitor the metering control system 44 for various fault conditions, and the controller 38 may terminate the metering operation if a fault condition is detected (e.g., regardless of whether the activation input device 56 is providing the activation command).

As indicated above, FIG. 2 is provided as an example. Other examples may differ from what is described with regard to FIG. 2.

Figure 3:
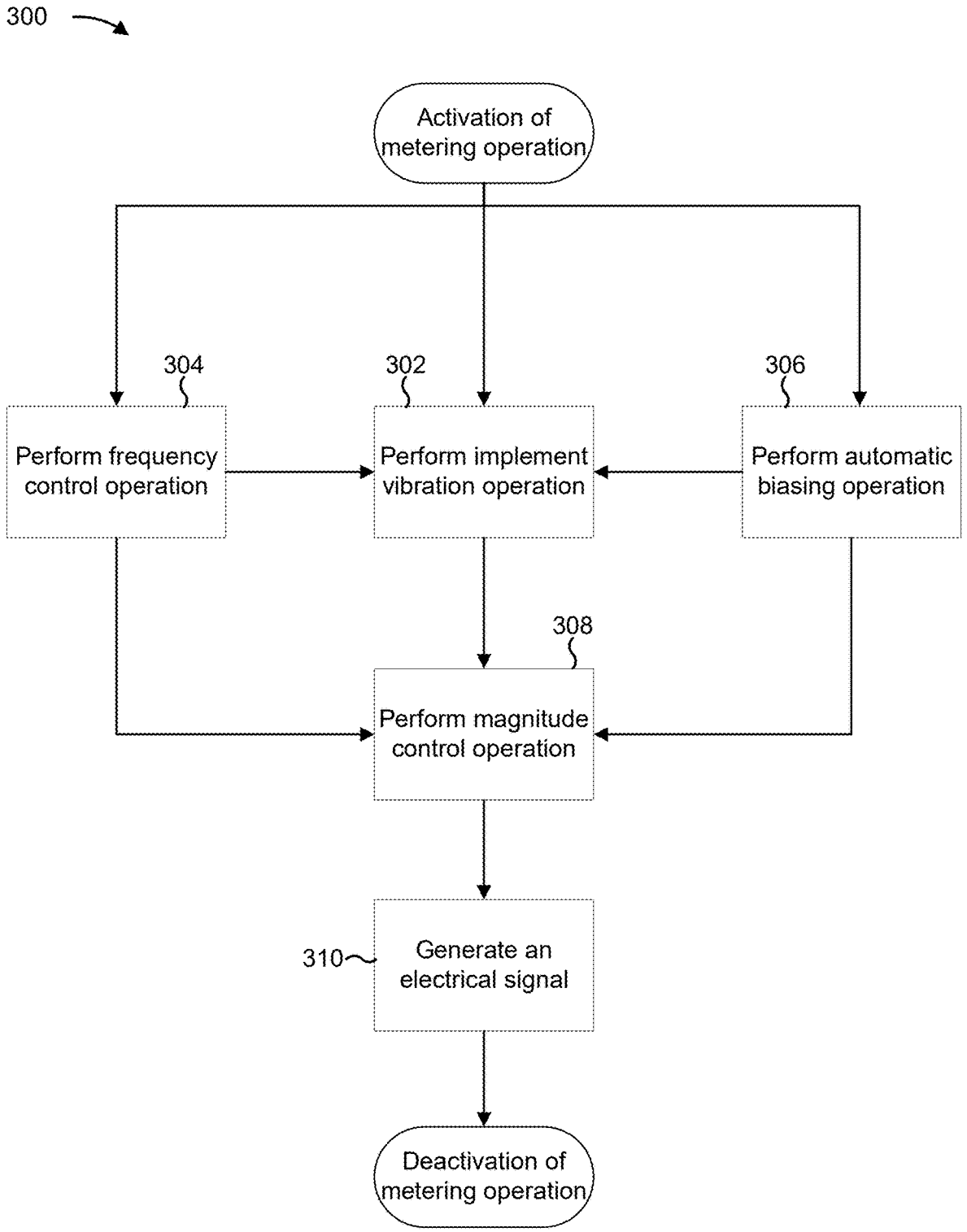
FIG. 3 is a diagram of an example process associated with implement metering control.

FIG. 3 is a diagram of an example process 300 associated with implement metering control. One or more process blocks shown in FIG. 3 may be performed by the controller 38 (e.g., using one or more memories 40 and/or one or more processors 42). For example, the controller 38 may perform the one or more blocks using the metering control system 44.

Upon activation of a metering operation (as described in connection with FIG. 2), process 300 may include performing an implement vibration operation based on a baseline metering signal (block 302). The implement vibration operation is described further in FIG. 4. Concurrently, process 300 may include performing (e.g., using frequency control component 48) a frequency control operation (block 304), and/or performing (e.g., using automatic biasing component 45) an automatic biasing operation (block 306). The frequency control operation is described further in FIG. 6 and the automatic biasing operation is described further in FIG. 5. As shown and described further in FIG. 4, outputs from the frequency control operation and/or the automatic biasing operation may be inputs to the implement vibration operation.

At block 308, process 300 may include performing (e.g., using magnitude control component 47) a magnitude control operation on an output signal of the implement vibration operation. The magnitude control operation is described further in FIG. 7. As shown and described further in FIG. 7, outputs from the frequency control operation and/or the automatic biasing operation may be inputs to the magnitude control operation. At block 310, process 300 may include generating an electrical signal (e.g., to power solenoid(s) 62) based on an output signal of the magnitude control operation, as described herein.

As indicated above, FIG. 3 is provided as an example. Other examples may differ from what is described with regard to FIG. 3.

Figure 4:
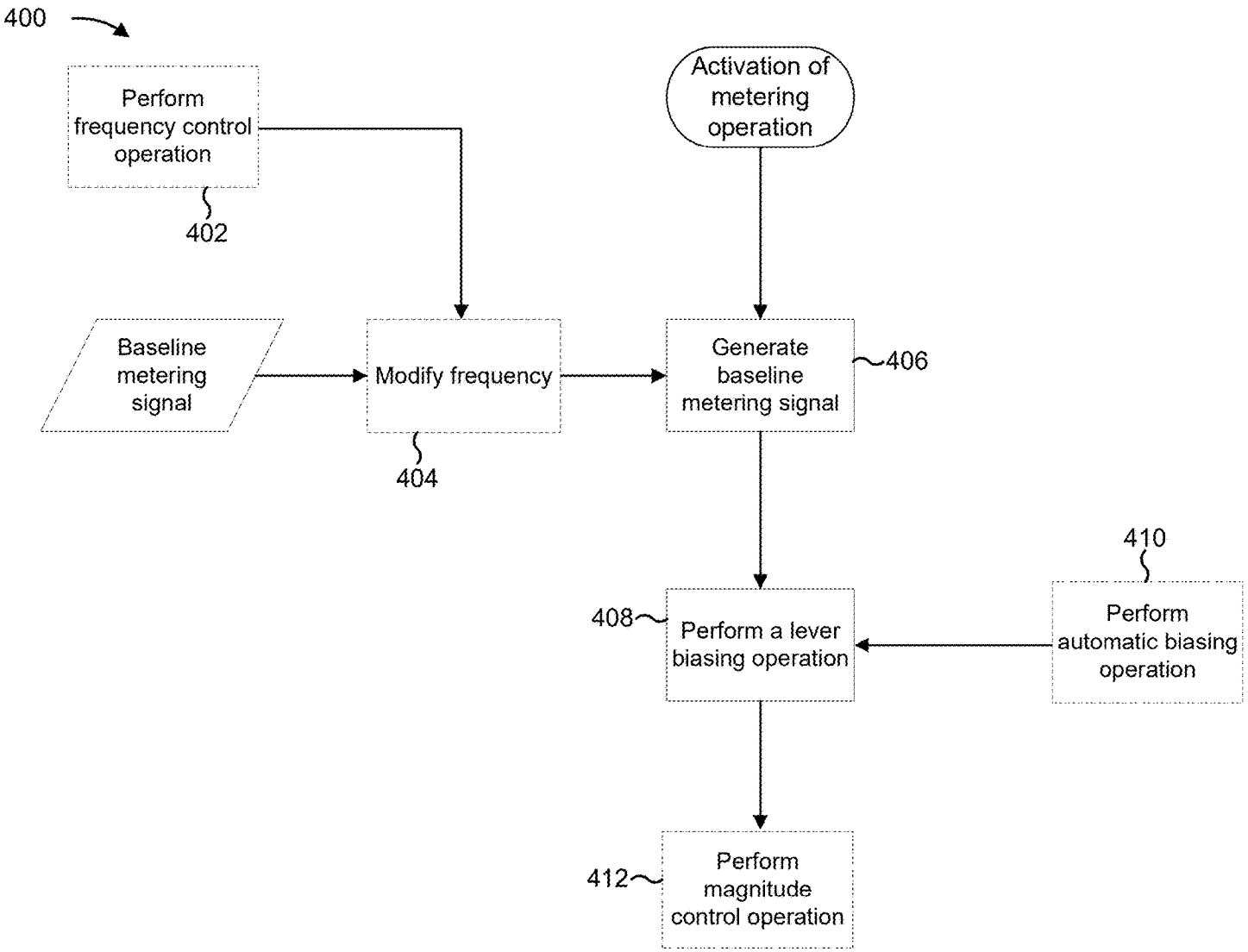
FIG. 4 is a diagram of an example process associated with an implement vibration operation.

FIG. 4 is a diagram of an example process 400 associated with an implement vibration operation. One or more process blocks shown in FIG. 4 may be performed by the controller 38 (e.g., using one or more memories 40 and/or one or more processors 42). For example, the controller 38 may perform the one or more blocks using the metering control system 44. Blocks shown in a dashed outline may be integrated with the implement vibration operation, but are described herein as being part of one or more other operations.

As shown, the controller 38 may store a baseline metering signal (e.g., a baseline metering waveform), as described herein. Process 400 may include performing (e.g., using frequency control component 48) a frequency control operation (block 402), resulting in a modification of a frequency of the baseline metering signal (block 404). The frequency control operation is described further in FIG. 6. At block 406, process 400 may include generating the baseline metering signal as modified by the frequency control operation.

At block 408, process 400 may include performing (e.g., using lever biasing component 46) a lever biasing operation with respect to the baseline metering signal as modified by the frequency control operation. For example, in connection with the lever biasing operation, the baseline metering signal may be scaled in accordance with an implement movement commanded by an operator. As shown, an output of an automatic biasing operation (block 410) may be an input to the lever biasing operation. For example, the automatic biasing operation may identify an implement movement that is to be performed, as described herein, and that implement movement may be an input to the lever biasing operation for scaling the baseline metering signal (e.g., an implement movement commanded by an operator and an implement movement that is automatically controlled may both result in the same manner of scaling the baseline metering signal using the logic of the lever biasing operation). The automatic biasing operation is described further in FIG. 5. Process 400 may include performing (e.g., using magnitude control component 47) a magnitude control operation on an output signal of the lever biasing operation (block 412). The magnitude control operation is described further in FIG. 7.

As indicated above, FIG. 4 is provided as an example. Other examples may differ from what is described with regard to FIG. 4.

Figure 5:
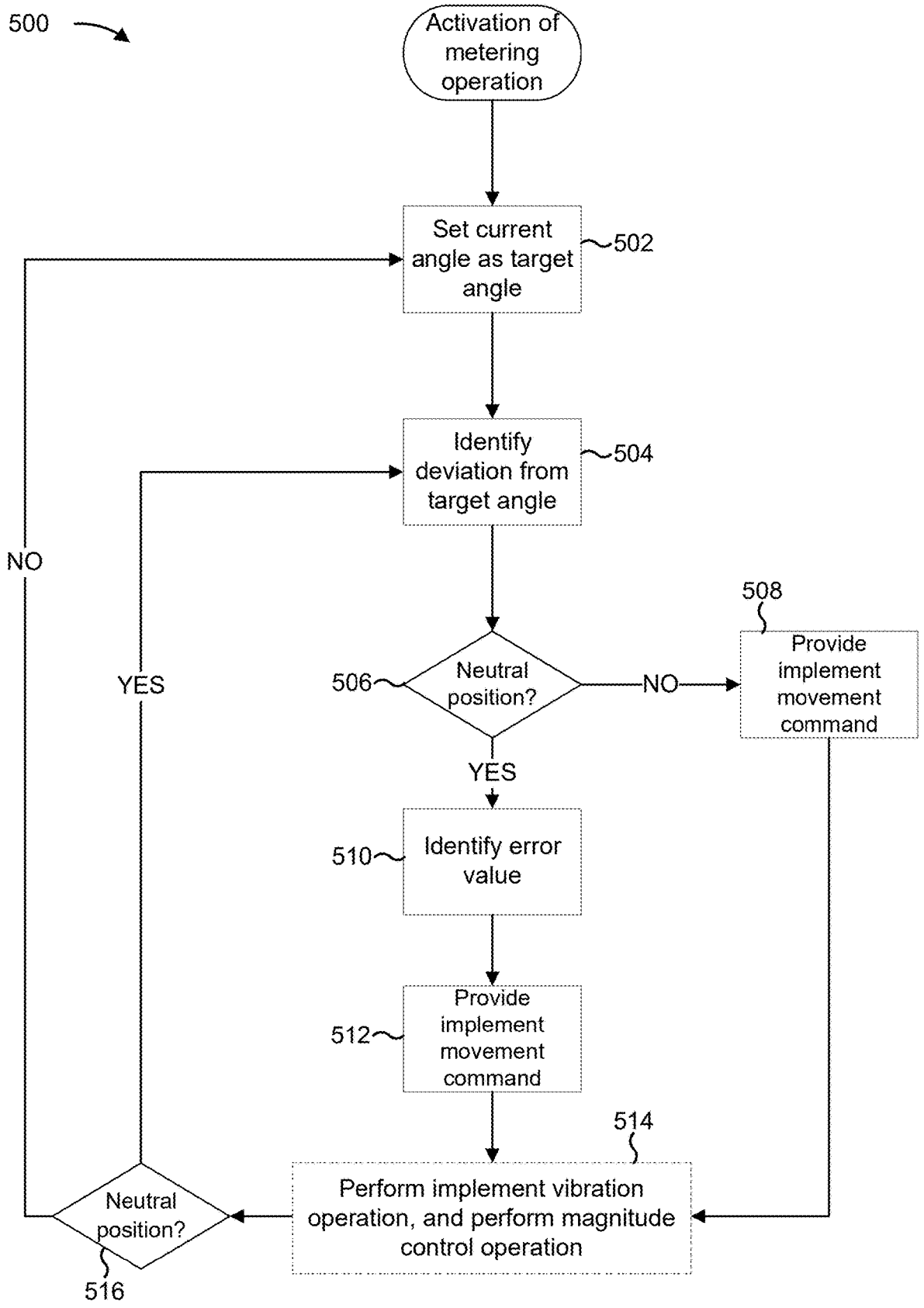
FIG. 5 is a diagram of an example process associated with an automatic biasing operation.

FIG. 5 is a diagram of an example process 500 associated with an automatic biasing operation. One or more process blocks shown in FIG. 5 may be performed by the controller 38 (e.g., using one or more memories 40 and/or one or more processors 42). For example, the controller 38 may perform the one or more blocks using the metering control system 44. Blocks shown in a dashed outline may be integrated with the automatic biasing operation, but are described herein as being part of one or more other operations.

Upon activation of a metering operation (as described in connection with FIG. 2), process 500 may include setting a current angle of the implement 22 as a target angle (block 502). Process 500 may include identifying an amount that an angle of the implement 22 has deviated from the target angle (block 504). Process 500 may include detecting whether the implement control 54 is in the neutral position (block 506). If the implement control 54 is not in the neutral position (e.g., there is operator-commanded movement of the implement 22), block 506—NO, then at block 508, process 500 may include providing an implement movement command for the operator-commanded movement as an input to the lever biasing operation (e.g., the controller 38 may issue the implement movement command to the lever biasing component 46). The lever biasing operation is described further in FIG. 4.

If the implement control 54 is in the neutral position (e.g., there is no operator-commanded movement of the implement 22), block 506—YES, then at block 510, process 500 may include identifying an error value for the target angle (e.g., a difference between a current angle of the implement 22 and the target angle). At block 512, process 500 may include providing an implement movement command based on the error value as an input to the lever biasing operation (e.g., the controller 38 may issue the implement movement command to the lever biasing component 46). At block 514, process 500 may include performing the implement vibration operation, using the output from block 508 or block 512 as an input to the lever biasing operation, and performing the magnitude control operation. The implement vibration operation and the lever biasing operation are further described in FIG. 4. The magnitude control operation is further described in FIG. 7.

At block 516, process 500 may include detecting again whether the implement control 54 is in the neutral position. If the implement control 54 is not in the neutral position (e.g., the implement 22 is being moved by the operator), block 516—NO, then process 500 may return to block 502. If the implement control 54 is in the neutral position (e.g., the implement 22 is not being moved by the operator), block 516—YES, then process 500 may return to block 504.

As indicated above, FIG. 5 is provided as an example. Other examples may differ from what is described with regard to FIG. 5.

Figure 6:
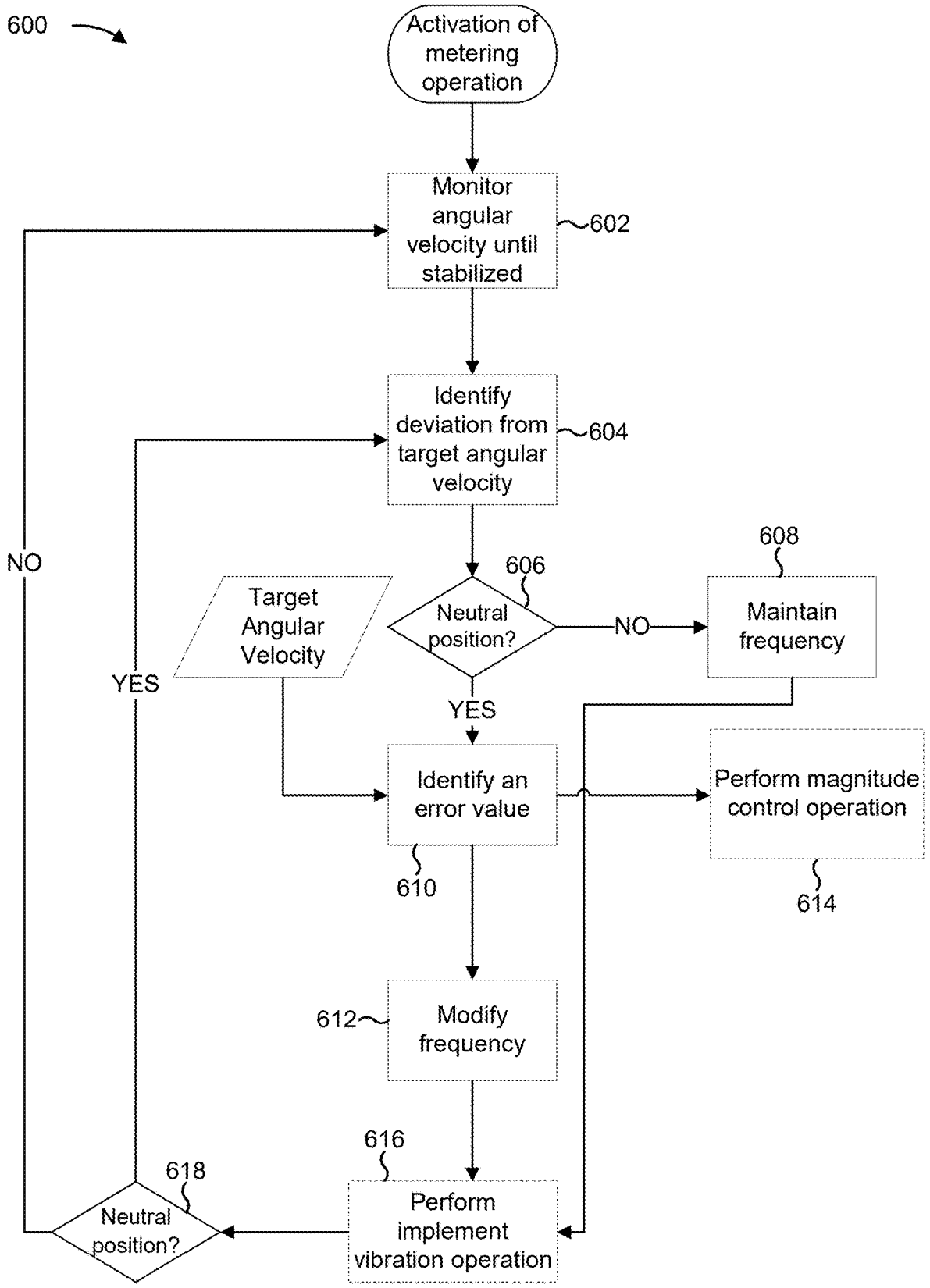
FIG. 6 is a diagram of an example process associated with a frequency control operation.

FIG. 6 is a diagram of an example process 600 associated with a frequency control operation. One or more process blocks shown in FIG. 6 may be performed by the controller 38 (e.g., using one or more memories 40 and/or one or more processors 42). For example, the controller 38 may perform the one or more blocks using the metering control system 44. Blocks shown in a dashed outline may be integrated with the frequency control operation, but are described herein as being part of one or more other operations.

Upon activation of a metering operation (as described in connection with FIG. 2), process 600 may include monitoring an angular velocity of the implement 22 until the angular velocity stabilizes (block 602). At block 604, process 600 may include identifying an amount that an angular velocity of the implement 22 has deviated from a target angular velocity (e.g., the controller 38 may store information indicating the target angular velocity). Process 600 may include detecting whether the implement control 54 is in the neutral position (block 606). If the implement control 54 is not in the neutral position (e.g., there is operator-commanded movement of the implement 22), block 606—NO, then at block 608, process 600 may include maintaining a frequency of a baseline metering signal (e.g., at a previous value).

If the implement control 54 is in the neutral position (e.g., there is no operator-commanded movement of the implement 22), block 606—YES, then at block 610, process 600 may include identifying an error value for the target angular velocity (e.g., a difference between a current angular velocity of the implement 22 and the target angular velocity). Moreover, process 600 may include modifying a frequency of the baseline metering signal based on the error value (block 612). As shown, the error value may also be an input for a magnitude control operation (block 614). The magnitude control operation is described further in FIG. 7. At block 616, process 600 may include performing the implement vibration operation using the frequency maintained at block 608 or the modified frequency at block 612. The implement vibration operation is further described in FIG. 4.

At block 618, process 600 may include detecting again whether the implement control 54 is in the neutral position. If the implement control 54 is not in the neutral position (e.g., the implement 22 is being moved by the operator), block 618—NO, then process 600 may return to block 602. If the implement control 54 is in the neutral position (e.g., the implement 22 is not being moved by the operator), block 618—YES, then process 600 may return to block 604.

As indicated above, FIG. 6 is provided as an example. Other examples may differ from what is described with regard to FIG. 6.

Figure 7:
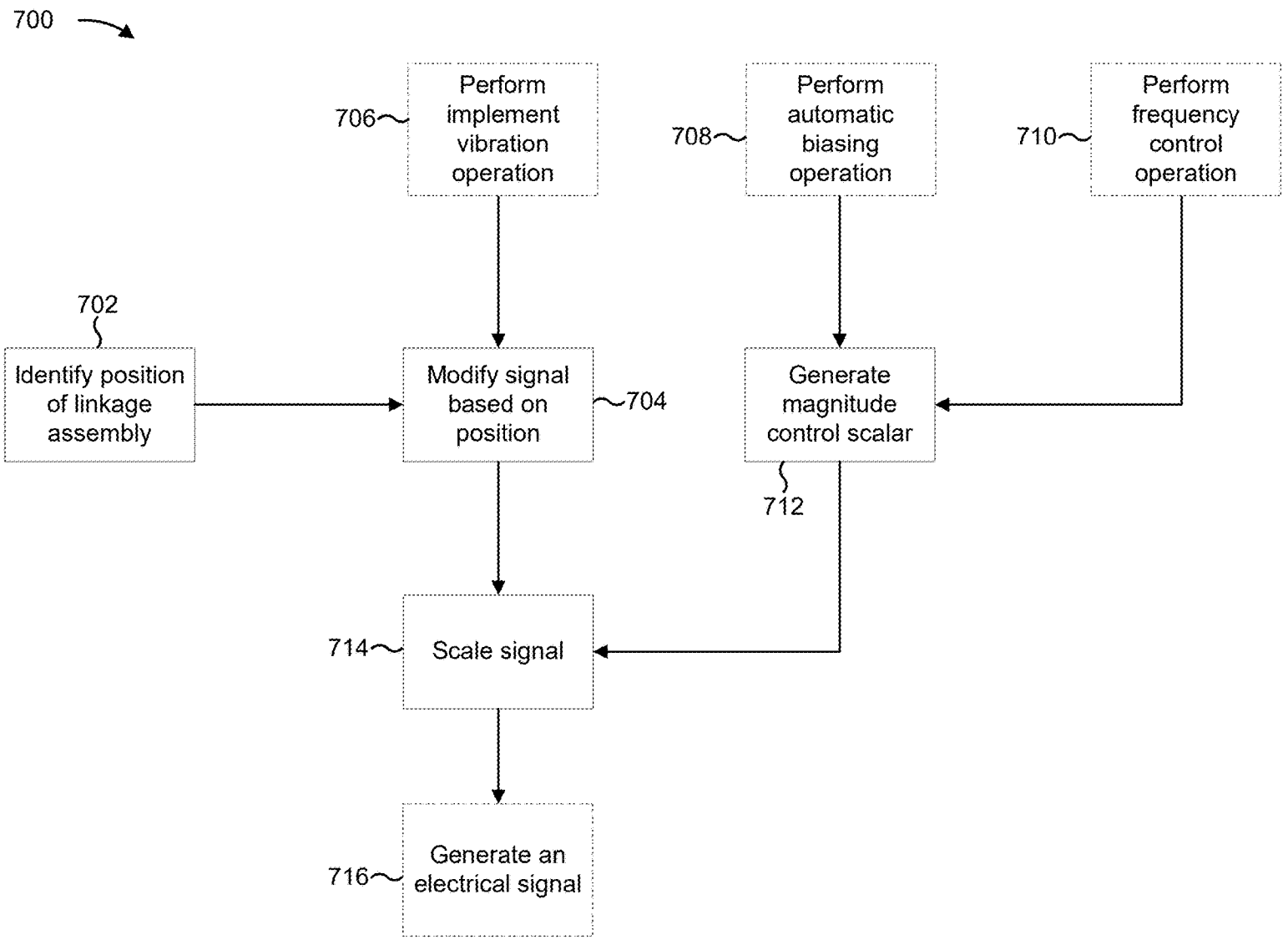
FIG. 7 is a diagram of an example process associated with a magnitude control operation.

FIG. 7 is a diagram of an example process 700 associated with a magnitude control operation. One or more process blocks shown in FIG. 7 may be performed by the controller 38 (e.g., using one or more memories 40 and/or one or more processors 42). For example, the controller 38 may perform the one or more blocks using the metering control system 44. Blocks shown in a dashed outline may be integrated with the magnitude control operation, but are described herein as being part of one or more other operations.

At block 702, process 700 may include identifying a position of the linkage assembly 18 (e.g., using sensor data indicating a height of the implement 22 and an angle of the implement 22). At block 704, process 700 may include modifying (e.g., using a linkage kinematic control map of the magnitude control component 47) a signal output by an implement vibration operation (block 706) based on the position of the linkage assembly 18. The implement vibration operation is further described in FIG. 4.

At block 708, process 700 may include performing an automatic biasing operation (e.g., using the automatic biasing component 45), and at block 710, process 700 may include performing a frequency control operation (e.g., using the frequency control component 48). The automatic biasing operation is further described in FIG. 5. The frequency control operation is further described in FIG. 6. Process 700 may include generating a magnitude control scalar (block 712). For example, as shown, the magnitude control scalar may be generated based on inputs from the automatic biasing operation and/or the frequency control operation. In some implementations, the magnitude control scalar may be generated based on a difference between a current angular velocity of the implement 22 and a target angular velocity, as described herein.

At block 714, process 700 may include scaling the signal output by the implement vibration operation as modified based on the position of the linkage assembly 18 (described at block 704). For example, the signal may be scaled using the magnitude control scalar. At block 716, process 700 may include generating an electrical signal (e.g., to power solenoid(s) 62) based on the scaled signal, as described herein.

As indicated above, FIG. 7 is provided as an example. Other examples may differ from what is described with regard to FIG. 7.

Figure 8:
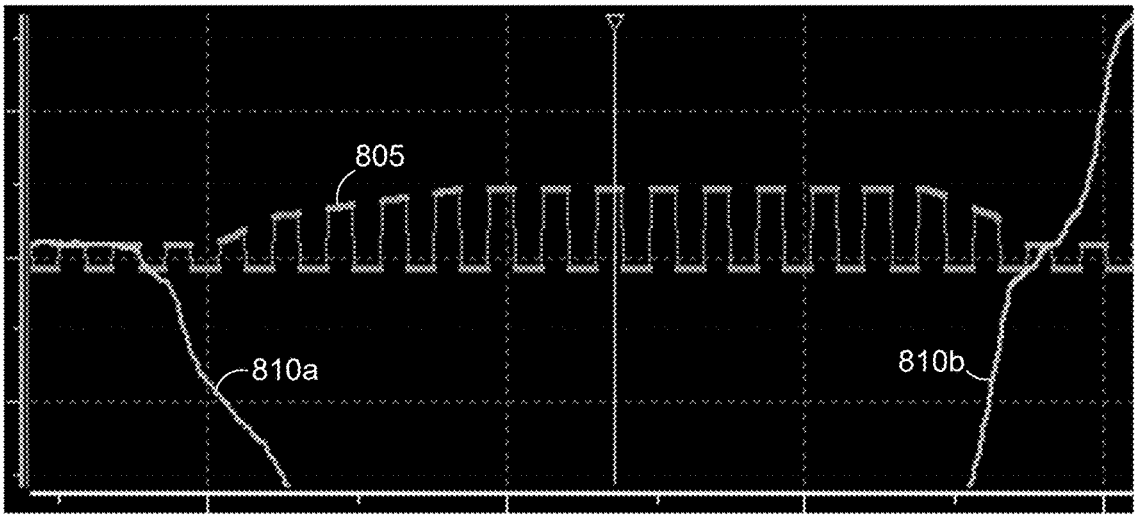
FIG. 8 shows example plots associated with implement metering control.
Figure 8:
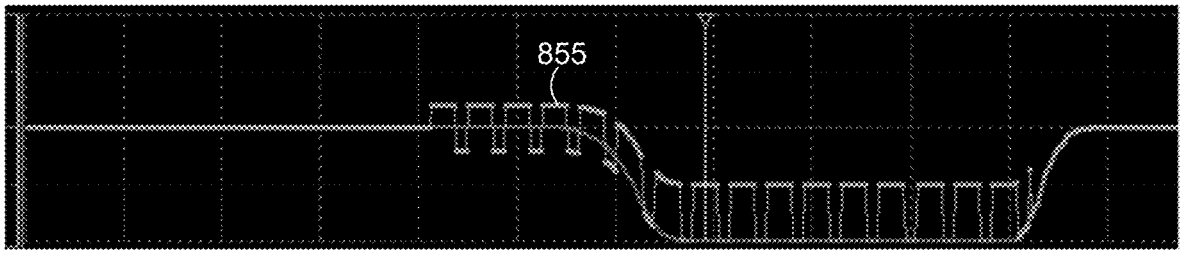

FIG. 8 shows example plots 800, 850 associated with implement metering control.

Plot 800 shows a metering control signal 805 produced by scaling a baseline metering signal in accordance with an implement movement signal 810 (shown as 810*a* and 810*b*). For plot 800, the implement movement signal 810 may represent movement of the implement control 54 out from a neutral position (the implement movement signal 810*a*) in connection with a rack command for the implement 22, followed by a returning of the implement control 54 to the neutral position (the implement movement signal 810*b*). As shown, pulses of the metering control signal 805 may begin with a steady magnitude (both in positive magnitude and negative magnitude), which may represent the baseline metering signal without scaling. In response to the implement movement signal 810*a*, the baseline metering signal may be scaled in accordance with the implement movement signal 810*a* by gradually increasing a positive magnitude component of the baseline metering signal (e.g., until the commanded rack position is reached), followed by gradually decreasing the positive magnitude component of the baseline metering signal in accordance with the implement movement signal 810*b*. As shown, the positive magnitude component can be gradually increased (or decreased) within a single pulse as well as between multiple pulses.

In other words, for a rack command, the controller 38 may adjust the baseline metering signal by gradually increasing a magnitude of a positive magnitude component of the baseline metering signal. In some examples, a rate at which the magnitude is gradually increased may be based on (e.g., proportional to) an intensity of an implement movement signal associated with the rack command. For example, an aggressiveness at which a waveform of the baseline metering signal is scaled may be proportional to an amount of implement lever command of the implement control 54.

Plot 800 is provided as an example, and other types of scaling of the baseline metering signal in connection with a rack command may be used.

Plot 850 shows a metering control signal 855 produced by scaling a baseline metering signal in accordance with a dump command. As shown, pulses of the metering control signal 855 may begin with a steady magnitude (both in positive magnitude and negative magnitude), which may represent the baseline metering signal without scaling. In response to an implement movement signal representing a dump command, the baseline metering signal is scaled in accordance with the implement movement signal by gradually decreasing a positive magnitude component of the baseline metering signal and a negative magnitude component of the baseline metering signal (e.g., until the commanded dump position is reached). As shown, the positive magnitude component can be gradually decreased within a single pulse as well as between multiple sequential pulses, and the negative magnitude component can be gradually decreased within a signal pulse as well as between multiple sequential pulses.

In other words, for a dump command, the controller 38 may adjust the baseline metering signal by gradually decreasing a magnitude of a positive magnitude component of the baseline metering signal and gradually decreasing a magnitude of a negative magnitude component of the baseline metering signal. In some examples, a rate at which the magnitudes are gradually decreased may be based on (e.g., proportional to) an intensity of an implement movement signal associated with the dump command. For example, an aggressiveness at which a waveform of the baseline metering signal is scaled may be proportional to an amount of implement lever command of the implement control 54.

Plot 850 is provided as an example, and other types of scaling of the baseline metering signal in connection with a dump command may be used.

The terms "positive magnitude" and "negative magnitude" are used herein to describe opposing deviations from an equilibrium position. In some contexts, a positive magnitude described herein may be considered as a negative magnitude, and a negative magnitude described herein may be considered as a positive magnitude.

As indicated above, FIG. 8 is provided as an example. Other examples may differ from what is described with regard to FIG. 8.

Figure 9:
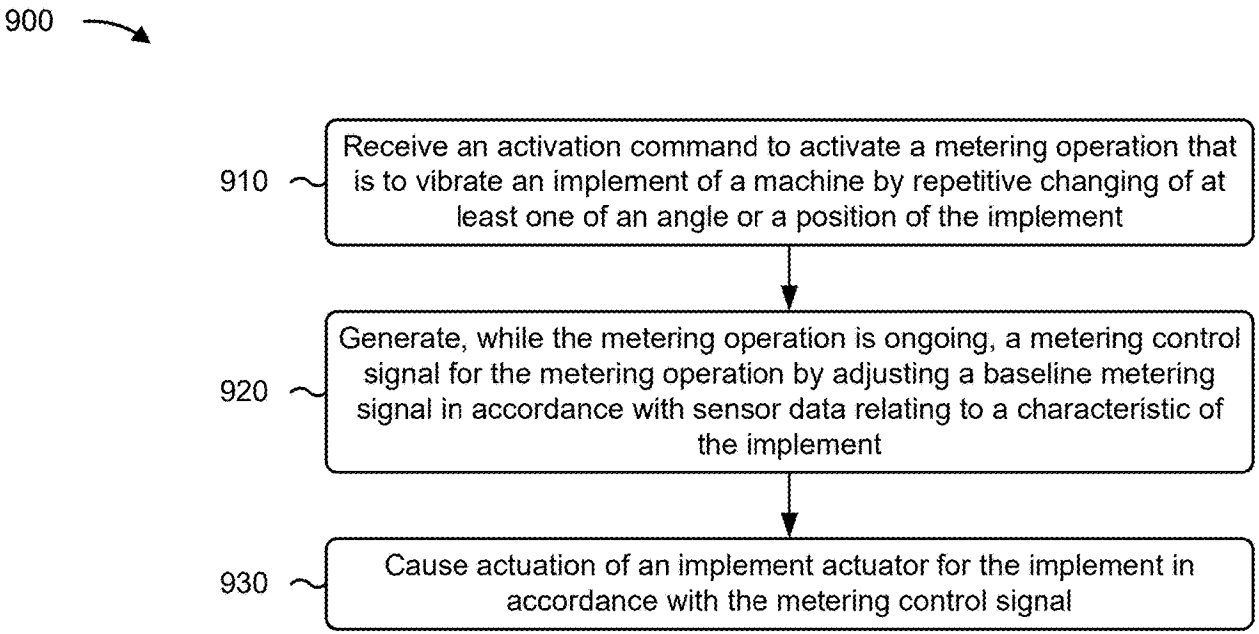
FIG. 9 is a flowchart of an example process associated with implement metering control.

FIG. 9 is a flowchart of an example process 900 associated with implement metering control. One or more process blocks of FIG. 9 may be performed by a controller (e.g., controller 38). Additionally, or alternatively, one or more process blocks of FIG. 9 may be performed by another device or a group of devices separate from or including the controller, such as another device or component that is internal or external to the machine 10.

As shown in FIG. 9, process 900 may include receiving an activation command to activate a metering operation that is to vibrate an implement of a machine by repetitive changing of at least one of an angle or a position of the implement (block 910). For example, the controller (e.g., using a communication component, an input component, a memory 40, and/or a processor 42) may receive the activation command, as described above.

As further shown in FIG. 9, process 900 may include generating, while the metering operation is ongoing, a metering control signal for the metering operation by adjusting a baseline metering signal in accordance with sensor data relating to a characteristic of the implement (block 920). For example, the controller may generate (e.g., using a memory 40 and/or a processor 42) the metering control signal for the metering operation by adjusting a baseline metering signal in accordance with sensor data relating to a characteristic of the implement, as described above.

Process 900 may include receiving an implement movement command for the implement, and generating an implement movement signal according to the implement movement command. Here, generating the metering control signal may include using the implement movement signal to modify the baseline metering signal.

Adjusting the baseline metering signal may be in accordance with a difference between an angle of the implement, indicated by the sensor data, and a target angle for the implement. Furthermore, process 900 may include generating an implement movement signal according to the difference between the angle and the target angle, and generating the metering control signal may include using the implement movement signal to modify the baseline metering signal.

Process 900 may include adjusting the baseline metering signal using a scalar value associated with a height of the implement in space and the angle of the implement indicated by the sensor data. Adjusting the baseline metering signal may be in accordance with a difference between an angular movement of the implement, indicated by the sensor data, and a target angular velocity.

Process 900 may include obtaining the sensor data from one or more position sensors configured to measure at least one of an angle of the implement or an angle of a lift arm that connects the implement and the machine.

As further shown in FIG. 9, process 900 may include causing actuation of an implement actuator for the implement in accordance with the metering control signal (block 930). For example, the controller (e.g., using a communication component, an output component, a memory 40, and/or a processor 42) may cause actuation of the implement actuator in accordance with the metering control signal, as described above. As an example, causing actuation of the implement actuator may include outputting the metering control signal to the implement actuator.

Although FIG. 9 shows example blocks of process 900, in some implementations, process 900 may include additional blocks, fewer blocks, different blocks, or differently arranged blocks than those depicted in FIG. 9. Additionally, or alternatively, two or more of the blocks of process 900 may be performed in parallel.

Figure 10:
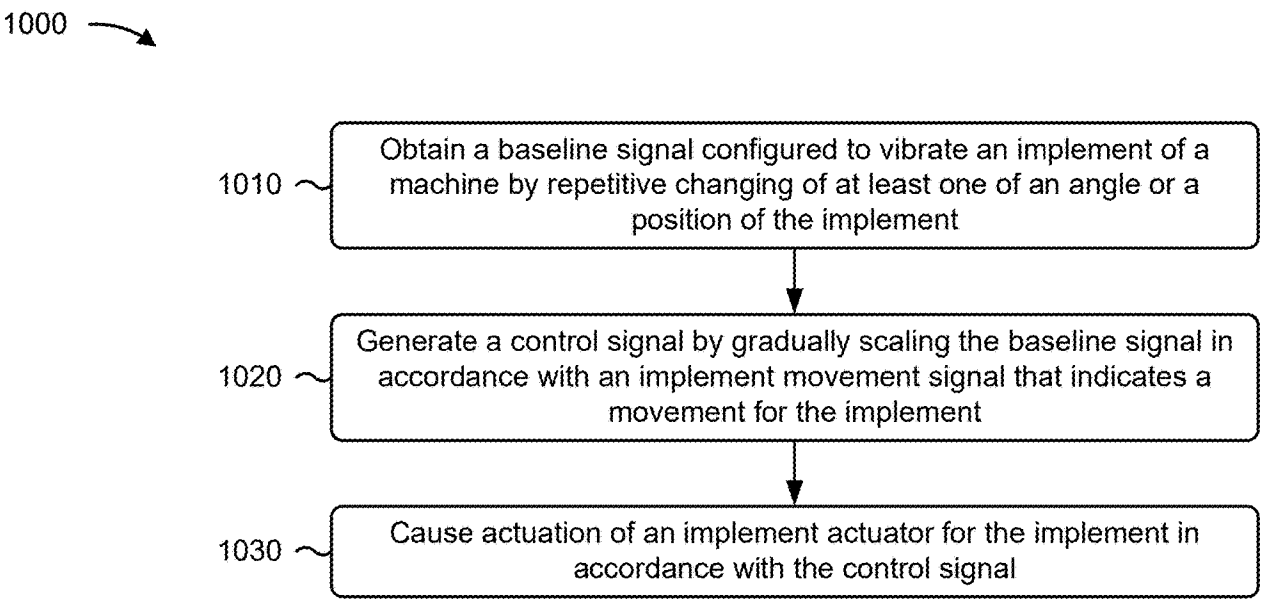
FIG. 10 is a flowchart of an example process associated with implement control.

FIG. 10 is a flowchart of an example process 1000 associated with implement control. One or more process blocks of FIG. 10 may be performed by a controller (e.g., controller 38). Additionally, or alternatively, one or more process blocks of FIG. 10 may be performed by another device or a group of devices separate from or including the controller, such as another device or component that is internal or external to the machine 10.

As shown in FIG. 10, process 1000 may include obtaining a baseline signal configured to vibrate an implement of a machine by repetitive changing of at least one of an angle or a position of the implement (block 1010). For example, the controller (e.g., using a memory 40 and/or a processor 42) may obtain the baseline signal, as described above.

As further shown in FIG. 10, process 1000 may include generating a control signal by gradually scaling the baseline signal in accordance with an implement movement signal that indicates a movement for the implement (block 1020). For example, the controller (e.g., using a memory 40 and/or a processor 42) may generate the control signal, as described above. In some examples, process 1000 may include receiving, from an implement control, an implement movement command for the implement, and generating the implement movement signal according to the implement movement command.

Generating the control signal may include gradually scaling at least one of a positive magnitude component or a negative magnitude component of the baseline signal in accordance with the implement movement signal. The movement may be a rack movement of the implement, and generating the control signal may include at least one of gradually increasing the positive magnitude component of the baseline signal or gradually decreasing the negative magnitude component of the baseline signal in accordance with the implement movement signal. Alternatively, the movement may be a dump movement of the implement, and generating the control signal may include at least one of gradually decreasing the positive magnitude component of the baseline signal or gradually decreasing the negative magnitude component of the baseline signal in accordance with the implement movement signal.

As further shown in FIG. 10, process 1000 may include causing actuation of an implement actuator for the implement in accordance with the control signal (block 1030). For example, the controller (e.g., using a communication component, an output component, a memory 40, and/or a processor 42) may cause actuation of the implement actuator, as described above.

Although FIG. 10 shows example blocks of process 1000, in some implementations, process 1000 may include additional blocks, fewer blocks, different blocks, or differently arranged blocks than those depicted in FIG. 10. Additionally, or alternatively, two or more of the blocks of process 1000 may be performed in parallel.

INDUSTRIAL APPLICABILITY

The control system described herein may be used with any work machine that has an implement configured to hold a loose payload material. For example, the control system may be used with a loader-type machine that has a bucket used to transport material at worksite. In a metering of a work machine's implement, an operator may rapidly oscillate a function of the implement to cause a shaking, or a vibration, that produces controlled material spillage. During metering, the operator may experience arm fatigue and/or may meter material imprecisely and inconsistently. Moreover, manual controls of the machine may lack the precision or proper calibration needed to produce precise and consistent metering.

While these issues may be addressed by automated metering, repeatable automated metering is complex due to numerous variables that can affect metering precision and consistency, such as linkage kinematics, implement position, implement size, implement weight, implement center of gravity, a payload material type, and/or a payload material mass. For example, throughout a metering cycle, a weight and/or a center of gravity of a payload may change, which can affect a precision and consistency of the automated metering. This can lead to undesirable resonance of the implement that can degrade metering precision and/or damage the work machine.

The control system described herein is useful for controlling an automated metering operation for a work machine's implement (e.g., bucket). In particular, while a metering operation is ongoing, the control system may obtain sensor data relating to a position of the implement (e.g., feedback based on the implement's motions). For example, the sensor data may relate to an angle (e.g., a tilt angle) of the implement. Moreover, the control system may generate a metering control signal for the metering operation by adjusting, in real time or near-real time, a baseline metering signal in accordance with the sensor data. In this way, the control system may correct deviations from a target position for the implement that may occur due to dynamic conditions during the metering operation. Thus, the control system is adaptable and resilient to different implement configurations and types and amounts of material payloads.

In addition, during a metering operation, the control system allows for an operator to command typical implement movement operations, such as dumping and racking movements of the implement and/or raising and lowering of the implement. For example, the control system may employ an implement movement command to modify the baseline metering signal to enable seamless operator control while metering is ongoing. In this way, the automated metering can be adjusted or corrected by an operator without interruption of the metering.

The control system described herein may produce automated metering that has a high level of precision and consistency, while providing suitable agitation of the implement's payload. Moreover, the control system may reduce excessive movement of the implement, such as undesirable resonance of the implement, that could affect the precision and consistency of the metering as well as damage the work machine. Furthermore, the control system enables operators of various skill to perform high-quality metering with reduced fatigue.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

When "a processor" or "one or more processors" (or another device or component, such as "a controller" or "one or more controllers" and/or "a sensor" or "one or more sensors") is described or claimed (within a single claim or across multiple claims) as performing multiple operations or being configured to perform multiple operations, this language is intended to broadly cover a variety of processor architectures and environments. For example, unless explicitly claimed otherwise (e.g., via the use of "first processor" and "second processor" or other language that differentiates processors in the claims), this language is intended to cover a single processor performing or being configured to perform all of the operations, a group of processors collectively performing or being configured to perform all of the operations, a first processor performing or being configured to perform a first operation and a second processor performing or being configured to perform a second operation, or any combination of processors performing or being configured to perform the operations. For example, when a claim has the form "one or more processors configured to: perform X; perform Y; and perform Z," that claim should be interpreted to mean "one or more processors configured to perform X; one or more (possibly different) processors configured to perform Y; and one or more (also possibly different) processors configured to perform Z."

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A control system for an implement of a machine, comprising:

one or more sensors configured to detect an angle of the implement;

an implement actuator configured to actuate the implement; and a controller electrically connected with the one or more sensors and the implement actuator, the controller configured to:

receive an activation command to activate a metering operation that is to vibrate the implement by repetitive changing of at least one of the angle or a position of the implement;

obtain, from the one or more sensors and based on receiving the activation command, sensor data indicating a current angle of the implement at a time of activation of the metering operation that defines a target angle for the implement;

generate, while the metering operation is ongoing, a metering control signal for the metering operation by generating an implement movement signal for returning the implement to the target angle in accordance with a difference between the angle of the implement, indicated by the sensor data, and the target angle for the implement, and scaling a baseline metering signal by gradually adjusting a magnitude component of the baseline metering signal based on the implement movement signal; and output the metering control signal, to the implement actuator, to cause actuation of the implement actuator in accordance with the metering control signal.

2. The control system of claim 1, wherein the controller is further configured to:

receive an implement movement command for the implement; and generate an additional implement movement signal according to the implement movement command, wherein the controller, to generate the metering control signal, is further configured to use the additional implement movement signal to modify the baseline metering signal.

3. The control system of claim 2, wherein the controller, to use the additional implement movement signal to modify the baseline metering signal, is configured to scale the baseline metering signal in accordance with the additional implement movement signal.

4. The control system of claim 3, wherein the controller, to scale the baseline metering signal, is configured to scale at least one of a positive magnitude component or a negative magnitude component of the baseline metering signal.

5. The control system of claim 1, wherein the controller, to generate the metering control signal, is further configured to adjust the baseline metering signal using a scalar value associated with a height of the implement in space and the angle of the implement indicated by the sensor data.

6. The control system of claim 1, wherein the controller, to generate the metering control signal, is further configured to adjust at least one of an amplitude or a frequency of the baseline metering signal in accordance with a difference between an angular movement of the implement, indicated by the sensor data, and a target angular movement.

7. The control system of claim 1, wherein the implement actuator includes a control valve controlled by one or more solenoids, and wherein the controller, to output the metering control signal to the implement actuator, is configured to output the metering control signal to the one or more solenoids.

8. A method, comprising:

receiving, by a controller of a machine, an activation command to activate a metering operation that is to vibrate an implement of the machine by repetitive changing of at least one of an angle or a position of the implement;

generating, by the controller and while the metering operation is ongoing, a metering control signal for the metering operation by generating an implement movement signal for returning the implement to a target angle in accordance with a difference between the angle of the implement, indicated by sensor data, and the target angle for the implement, and scaling a baseline metering signal by gradually adjusting a magnitude component of the baseline metering signal based on the implement movement signal; and causing, by the controller, actuation of an implement actuator for the implement in accordance with the metering control signal.

9. The method of claim 8, further comprising:

receiving an implement movement command for the implement; and generating an additional implement movement signal according to the implement movement command, wherein generating the metering control signal further comprises using the additional implement movement signal to modify the baseline metering signal.

10. The method of claim 8, wherein generating the metering control signal further comprises adjusting the baseline metering signal in accordance with a difference between an angular movement of the implement, indicated by the sensor data, and a target angular movement.

11. The method of claim 8, further comprising:

obtaining the sensor data from one or more position sensors configured to measure at least one of the angle of the implement or an angle of a lift arm that connects the implement and the machine.

12. A controller, comprising:

one or more memories; and one or more processors, communicatively coupled to the one or more memories, configured to:

obtain, from one or more sensors, sensor data relating to an angle of an implement of a machine during a metering operation for the implement;

generate, while the metering operation for the implement is ongoing, a metering control signal for the metering operation by generating an implement movement signal for returning the implement to a target angle in accordance with a difference between the angle of the implement, indicated by the sensor data, and the target angle for the implement, and scaling a baseline metering signal by gradually adjusting a magnitude component of the baseline metering signal based on the implement movement signal; and cause actuation of an implement actuator for the implement in accordance with the metering control signal.

13. The controller of claim 12, wherein the one or more processors are further configured to:

receive an implement movement command for the implement; and generate an additional implement movement signal according to the implement movement command, wherein the one or more processors, to generate the metering control signal, are further configured to use the additional implement movement signal to modify the baseline metering signal.

14. The controller of claim 12, wherein the one or more processors, to generate the metering control signal, are further configured to adjust the baseline metering signal in accordance with a difference between an angular movement of the implement, indicated by the sensor data, and a target angular movement.

15. The controller of claim 12, wherein the one or more processors, to scale the baseline metering signal, are configured to gradually adjust at least one of a positive magnitude component or a negative magnitude component of the baseline metering signal.

16. The controller of claim 12, wherein the one or more processors, to cause actuation of the implement actuator, are configured to:

output the metering control signal to one or more solenoids for a control valve for the implement actuator.

17. A method, comprising:

obtaining, by a controller, a baseline signal configured to vibrate an implement of a machine by repetitive changing of at least one of an angle or a position of the implement;

generating, by the controller, a control signal by generating an implement movement signal that indicates a movement for the implement and scaling the baseline signal by gradually adjusting a magnitude component of the baseline signal in accordance with the implement movement signal; and causing, by the controller, actuation of an implement actuator for the implement in accordance with the control signal.

18. The method of claim 17, wherein generating the control signal comprises:

generating the control signal by gradually adjusting at least one of a positive magnitude component or a negative magnitude component of the baseline signal in accordance with the implement movement signal.

19. The method of claim 18, wherein the movement is a rack movement of the implement, and wherein generating the control signal comprises:

generating the control signal by at least one of gradually increasing the positive magnitude component of the baseline signal or gradually decreasing the negative magnitude component of the baseline signal in accordance with the implement movement signal.

20. The method of claim 18, wherein the movement is a dump movement of the implement, and wherein generating the control signal comprises:

generating the control signal by at least one of gradually decreasing the positive magnitude component of the baseline signal or gradually decreasing the negative magnitude component of the baseline signal in accordance with the implement movement signal.

21. A controller, comprising:

one or more memories; and one or more processors, communicatively coupled to the one or more memories, configured to:

obtain a baseline signal configured to vibrate an implement of a machine by repetitive changing of at least one of an angle or a position of the implement;

generate a control signal by generating an implement movement signal that indicates a movement for the implement and scaling the baseline signal by gradually adjusting at least one of a positive magnitude component or a negative magnitude component of the baseline signal in accordance with the implement movement signal; and output the control signal, to an implement actuator for the implement, to cause actuation of the implement actuator in accordance with the control signal.

* * * * *